US006501451B1

(12) United States Patent
Sakashita

(10) Patent No.: US 6,501,451 B1
(45) Date of Patent: Dec. 31, 2002

(54) LIQUID CRYSTAL DISPLAY PANEL DRIVING DEVICE AND METHOD

(75) Inventor: Yukihiko Sakashita, Hadano (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/176,273

(22) Filed: Oct. 21, 1998

(30) Foreign Application Priority Data

Oct. 23, 1997 (JP) ..... 9-290968

(51) Int. Cl.[7] ..... G09G 3/36

(52) U.S. Cl. ..... 345/87; 345/88; 345/92; 345/94; 345/95; 345/98; 345/99; 345/100; 345/605

(58) Field of Search ..... 345/87, 99, 100, 345/88, 92, 94, 95, 98, 605

(56) References Cited

U.S. PATENT DOCUMENTS

| | | | | |
|---|---|---|---|---|
| 5,119,084 A | | 6/1992 | Kawamura et al. | 340/784 |
| 5,528,257 A | | 6/1996 | Okumura et al. | 345/99 |
| 5,657,037 A | | 8/1997 | Okada et al. | 345/94 |
| 5,764,209 A | * | 6/1998 | Hawthorne et al. | 345/87 |
| 5,870,075 A | * | 2/1999 | Yamazaki et al. | 345/149 |
| 5,894,300 A | * | 4/1999 | Takizawa | 345/115 |
| 5,945,972 A | * | 8/1999 | Okumura et al. | 345/98 |

FOREIGN PATENT DOCUMENTS

| | | |
|---|---|---|
| EP | 0 657 860 | 6/1995 |
| JP | 3-96993 | 4/1991 |

OTHER PUBLICATIONS

H. Okumura et al., "A New Low–Image–Lag Drive Method for Large–Size LCTVs", Toshiba R&D Center, Kawasaki, Japan, SID 92 Digest, May 17, 1992.

* cited by examiner

*Primary Examiner*—Richard Hjerpe
*Assistant Examiner*—Jean Lesperance
(74) *Attorney, Agent, or Firm*—Fitzpatrick, Cella, Harper & Scinto

(57) ABSTRACT

A liquid crystal display panel driving device includes a first signal level detection unit for detecting a level of an input image signal, a memory unit for delaying the input image signal by an arbitrary constant time period, a second signal level detection unit for detecting a level of a signal output from the memory unit, and a corrected-image-signal calculation unit for correcting the input image signal based on an output from the first signal level detection unit, an output from the second signal level detection unit, and the arbitrary constant time period, and for outputting the resultant image signal.

7 Claims, 9 Drawing Sheets

FIG.8

CURRENT-FRAME DATA

| PRECEDING-FRAME DATA | | UPPER 4 BITS OF ADDRESS | | | | | | | |
|---|---|---|---|---|---|---|---|---|---|
| | | 0000b | 0001b | 0010b | · · · | 0111b | 1000b | · · · | 1111b |
| LOWER 4 BITS OF ADDRESS | 0000b | 0 | 6 | 15 | · · · | 31 | 20 | · · · | 0 |
| | 0001b | -8 | 0 | 10 | · · · | 28 | 14 | · · · | 0 |
| | 0010b | -10 | -10 | 0 | · · · | 20 | 10 | · · · | 0 |
| | ⋮ | ⋮ | ⋮ | ⋮ | ⋮ | ⋮ | ⋮ | ⋮ | ⋮ |
| | 0111b | -34 | -28 | -20 | · · · | 0 | 8 | · · · | 0 |
| | 1000b | -10 | -20 | -17 | · · · | -18 | 0 | · · · | 0 |
| | ⋮ | ⋮ | ⋮ | ⋮ | ⋮ | ⋮ | ⋮ | ⋮ | ⋮ |
| | 1111b | 0 | -10 | -15 | · · · | -28 | -18 | · · · | 0 |

LIQUID CRYSTAL DISPLAY PANEL DRIVING DEVICE AND METHOD

BACKGROUND OF THE INVENTION

1. Field of the Invention

The present invention relates to a liquid crystal display panel driving device and method for improving the display characteristics of a liquid crystal display panel.

The invention also relates to a response-speed improving circuit in a liquid crystal display panel.

2. Description of the Related Art

Some conventional devices for improving the display characteristics of a liquid crystal display panel aim at improvement in the response speed of a liquid crystal, such as ones described in Japanese Patent Laid-Open Application (Kokai) No. 3-96993 (1991) and in U.S. Pat. No. 5,119,084.

For example, Japanese Patent Laid-Open Application (Kokai) No. 3-96993 (1991) describes the following problems in conventional liquid crystal display devices. That is, "it is known that in liquid crystal display devices, a change in the orientation of liquid-crystal molecules for a change in the electric field delays due to the viscosity of the liquid crytal used in the device, resulting in large rise time and fall time, i.e., inferior transient response characteristics. When displaying a still image by a liquid crystal display device, such inferior transient response characteristics of liquid crystals cause no problem. However, when displaying a moving image by a liquid crystal display device, appearance of afterimage in a displayed image thereby to degrade the quality of the reproduced image is a problem."

In order to reduce the occurrence of such a problem, Japanese Patent Laid-Open Application (Kokai) No. 3-96993 (1991) discloses the following afterimage cancelling circuit for a liquid-crystal display device.

In the afterimage cancelling circuit disclosed in Japanese Patent Laid-Open Application (Kokai) No. 3-96993 (1991), a difference signal, representing the difference between image signals to be displayed on a liquid crystal display device and image signals separated by one-frame period or one-field period, is generated. When the value of the difference signal is larger than a predetermined value, the difference signal is added to an input image signal in order to prevent appearance of afterimage in an image displayed on the liquid crystal display device. When the value of the difference signal is smaller than the predetermined value, the difference signal is treated as noise, and an input image signal is output without adding the difference signal, otherwise the difference signal is subtracted from the input image signal in order to output an image signal having reduced noise.

The afterimage cancelling circuit disclosed in Japanese Patent Laid-Open Application (Kokai) No. 3-96993 (1991) will now be described with reference to FIG. 9.

In the afterimage cancelling circuit shown in FIG. 9, an image signal input to an input terminal 901 is supplied to subtracters 902 and 904 as a signal to be subjected to subtraction, as well as to an adder 907.

An output signal from a coefficient circuit 905 is supplied to the subtracter 902 as a subtraction signal. An output signal from the subtracter 902 is stored in a memory 903. For example, the memory 903 comprises a FIFO (first-in first-out) memory, or two memories configured so as to alternately perform writing and reading for every one-field period (or one-frame period), so that an image signal which precedes the current image signal for a one-field (or a one-frame) by the one-field period (or one-frame period) is read from the memory 903 and is supplied to the subtracter 904 as a subtraction signal.

The subtracter 904 uses the current image signal supplied from the input terminal 901 as a signal to be subjected to subtraction, and supplies a difference signal obtained by subtracting an image signal which precedes the current image signal for a one-field period (or a one-frame period) by the one-field period (or the one-frame period) read from the memory 903 from the current image signal to coefficient circuits 905 and 906.

The coefficient circuit 905 multiplies the difference signal output from the subtracter 904, for example, by a coefficient smaller than 1, and supplies the subtracter 902 with the resultant signal as a subtraction signal.

That is, according to the operation of a loop of the subtracter 902→the memory 903→the subtracter 904→the coefficient circuit 905→the subtracter 902, a difference signal representing the difference between image signals separated by a one-frame period or a one-field period (a motion detection signal) is output from the subtracter 904.

The difference signal output from the subtracter 904 is supplied to the coefficient circuit 906.

When the value of the difference signal supplied from the subtracter 904 to the coefficient circuit 906 is within a range of 0~+a or 0~−a, i.e., smaller than a predetermined value |a|, an output signal obtained by multiplying the input signal by a coefficient having a polarity inverse to the polarity of the input signal is output to the adder 907, which outputs an image signal obtained by subtracting the difference signal from the input image signal to an output terminal 908. In the output signal in this state, noise is reduced in the image signal.

When the value of the difference signal supplied from the subtracter 904 to the coefficient circuit 906 is outside the range of 0~+a or 0~−a, i.e., larger than the predetermined value |a|, an output signal obtained by multiplying the input signal by a coefficient having the same polarity as the polarity of the input signal is output to the adder 907, which outputs an image signal obtained by adding the difference signal to the input image signal to the output terminal 908. The output signal in this state can cancel afterimage in an image displayed on the liquid crystal display device.

However, studies done by the inventor of the present invention have revealed that the afterimage cancelling circuit described above has problems. That is, for example, when applying a signal voltage of +5 V to an image signal for a frame and then applying a signal voltage of +15 V to an image signal for the next frame, the difference between the applied signal voltages is 10 V. On the other hand, when applying a signal voltage of +10 V to an image signal for a frame and then applying a signal voltage of +20 V for an image signal for the next frame, the difference between the applied signal voltages is also 10 V. However, when correction is performed by using the same difference signal for the two cases, optimum correction is not always obtained. This is because a liquid crystal behaves differently depending on the value of the level of the signal applied thereto. That is, even if the same difference signal is applied, optimum correction is not obtained unless the value of the level of the signal applied to the liquid crystal is considered. This fact is not taken into consideration in Japanese Patent Laid-Open Application (Kokai) No. 96993 (1991).

For example, in display devices using twisted nematic liquid crystals, vertically aligned liquid crystals and PDLC's (polymer dispersed liquid crystals), the response speed greatly differs depending on the absolute values of the level of the signal for the preceding frame and the level of the signal for the current frame.

Although the response speed from 0% to 100% of the maximum luminance level is sufficiently high, the response speed from 0% to 10% of the maximum luminance level is very low.

As described above, since the response speed greatly differs depending on the values of the level of the signal for the preceding frame and the level of the signal for the current frame, an optimum response speed cannot be obtained according to the conventional correction method that does not depend on the signal level.

For example, if adjustment is performed so as to be adapted to a signal level having a high response speed, sufficient improvement is not obtained for a signal level having a low response speed. On the other hand, if adjustment is performed so as to be adapted to a signal level having a low response speed, an image having prominent noise is, in some cases, obtained because of excessive correction.

SUMMARY OF THE INVENTION

It is an object of the present invention to solve the above-described problems.

According to one aspect, the present invention which achieves the above-described object relates to a liquid crystal display panel driving device including first signal level detection means for detecting a signal level of an input image signal, memory means for delaying the input image signal by an arbitrary constant time period, second signal level detection means for detecting a level of a signal output from the memory means, and corrected-image-signal calculation means for correcting the input image signal based on an output from the first signal level detection means, an output from the second signal level detection means, and the arbitrary constant time period, and for outputting the resultant image signal.

According to another aspect, the present invention which achieves the above-described object relates to a liquid crystal display panel driving device including first encoding means for encoding a level of an input image signal, memory means for delaying the input image signal by an arbitrary constant time period, second encoding means for encoding a level of a signal output from the memory means, corrected-image-signal calculation means for obtaining a correction value based on outputs from the first and second encoding means, and addition-subtraction means for adding/subtracting the corrected value to/from the input image signal.

According to still another aspect, the present invention which achieves the aboved-described object relates to a liquid crystal display panel driving device including first encoding means for encoding a level of an input image signal, second encoding means for encoding the level of the input image signal, memory means for delaying an output from the second encoding means by an arbitrary constant time period, corrected-image-signal calculation means for obtaining a correction value based on an output from the first encoding means and an output from the memory means, and addition-subtraction means for adding/subtracting the correction value to/from the input image signal.

According to yet another aspect, the present invention which achieves the aboved-described object relates to a liquid crystal display panel driving device including encoding means for encoding a level of an input image signal, memory means for delaying an output from the encoding means by an arbitrary constant time period, corrected-image-signal calculation means for obtaining a correction value based on an output from the encoding means and an output from the memory means, and addition-subtraction means for adding/subtracting the correction value to/from the input image signal.

In one embodiment, the corrected-image-signal calculation means corrects the input image signal so as to maintain a linear relationship between the difference between the output from the first signal level detection means and the output from the second signal level detection means and a step level of a display luminance of a liquid crystal display panel, based, in depedence upon a value of a step response output in a relationship between a driving voltage and the display luminance of the liquid crystal display panel after the arbitrary constant time period, on levels before and after the step.

In another embodiment, the corrected-image-signal calculation means comprises a look-up table.

In still another embodiment, the arbitrary constant time period is a time period until the input image signal again drives the same pixel of the liquid crystal display panel.

According to yet a further aspect, the present invention which achieves the above-described object relates to a liquid crystal display panel driving method including the step of driving a liquid crystal display device by an image signal corrected so as to maintain a linear relationship between a step level of the image signal and a step level of a display luminance of the liquid crystal display panel, based, in depedence upon a value of a step response output in a relationship between a driving voltage and the display luminance of the liquid crystal display panel after an arbitrary constant time period, on levels before and after the step.

In one embodiment, when the level of the current image signal is low, finer correction is performed than when the level is high.

In another embodiment, the arbitrary constant time period is a time period until the input image signal again drives the same pixel of the liquid crystal panel.

According to the present invention, by correcting the driving signal for the liquid crystal display panel to an optimum value in accordance with the level of the current input image signal and the level of the past input image signal driving the same pixel, the display characteristics of the liquid crystal display panel can be improved.

It is thereby possible to display an image having a smaller afterimage even when displaying a moving image. Hence, it is possible to use even a liquid crystal display panel having a low response speed for use in displaying a moving image.

The foregoing and other objects, advantages and features of the present invention will become more apparent from the following detailed description of the preferred embodiments taken in conjunction with the accompanying drawings.

BRIEF DESCRIPTION OF THE DRAWINGS

FIG. 8 is a diagram illustrating an example of data arrangement in an LUT (look-up table)

DETAILED DESCRIPTION OF THE PREFERRED EMBODIMENTS

First Embodiment

Figure 1:
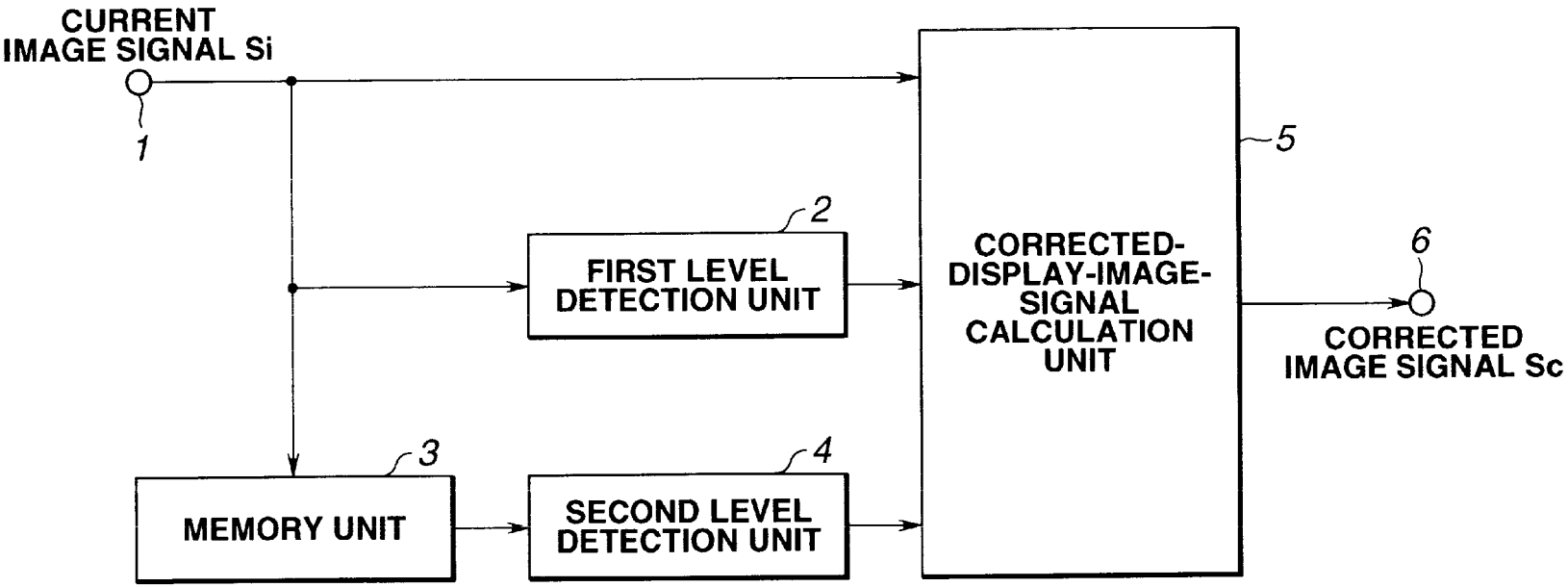
FIG. 1 is a block diagram illustrating the configuration of a liquid crystal display panel driving device according to a first embodiment of the present invention.

FIG. 1 is a block diagram illustrating the configuration of a liquid crystal display panel driving device according to a first embodiment of the present invention. In FIG. 1, reference numeral 1 represents an input terminal for the current image signal. A first level detection unit 2 receives the input current image signal. A memory unit 3 delays the current image signal by a predetermined time period. A second level detection unit 4 receives the image signal which precedes the current image signal by the predetermined time period and is output from the memory unit 3. A corrected-display-image-signal calculation unit 5 is connected to the input terminal 1, the first level detection unit 2 and the second level detection unit 4, and calculates an image signal to be displayed based on signals input from these units. An output signal from the corrected-display-image-signal calculation unit 5 is supplied to an output terminal 6.

Figure 6A:
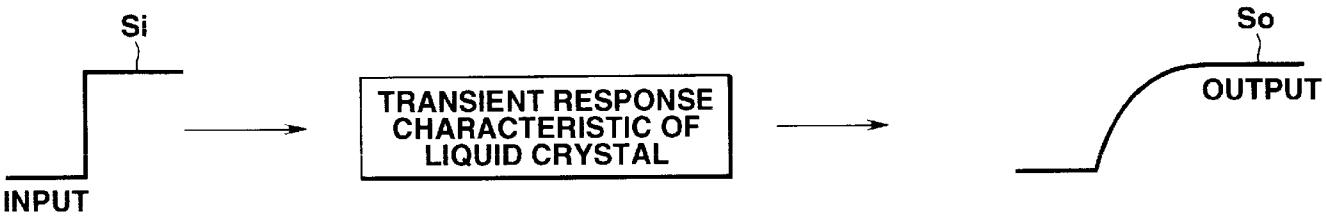
FIGS. 6A and 6B are diagrams illustrating the principle of correction of the response speed of a liquid crystal display panel according to the present invention.
Figure 6B:
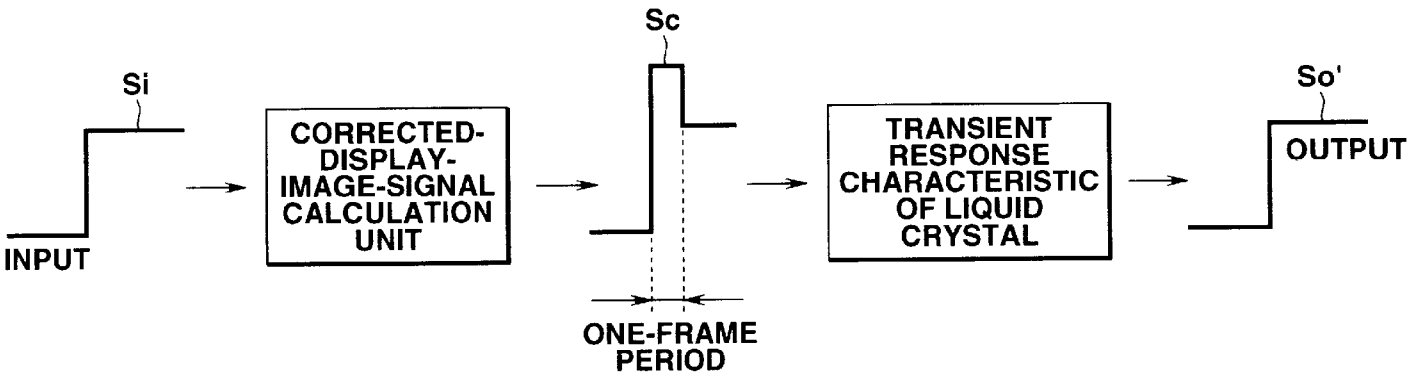

First, a description will be provided of the principle of correction of the response speed performed by a response-speed correction circuit in a liquid crystal display panel according to the present invention, with reference to FIGS. 6A and 6B.

In FIGS. 6A and 6B, $S_i$ represents an input image signal to be displayed on the liquid crystal display panel.

In general, a change in the orientation of the molecules of a liquid crystal used in a liquid crystal display panel lags behind a change in the electric field, due to the viscosity of the liquid crystal. Hence, for example, when the signal $S_i$ in the form of a stepwise voltage is input to the liquid crystal display panel, the rise of display of the liquid crystal display panel is delayed, as indicated by $S_o$ in FIG. 6A due to the transient response characteristics of the liquid crystal.

Although illustration is omitted, the fall of display of the liquid-crystal display panel is delayed in the same manner.

In the first embodiment, as shown in FIG. 6B, the corrected-display-image-signal calculation unit 5 converts the input signal $S_i$ into a signal $S_c$ such that the signal $S_o$ obtained from the input signal $S_i$ by being timewise delayed due to the transient response characteristics of the liquid crystal is substantially corrected as S*o*'.

A signal that allows the response of the liquid crystal to reach a desired signal level within a one-field period is selected as the image signal $S_c$ after correction.

For example, when displaying an image signal having a refresh rate of 60 Hz, an exact display cannot be performed and afterimage is generated unless the response of the liquid crystal is such that it reaches a desired final value within about 16.6 ms.

Accordingly, a signal that allows the response of the liquid crystal to reach a desired value within about 16.6 ms is used as the image signal to be output to the liquid crystal display panel.

A method for calculating the corrected output image signal $S_c$ will now be described with reference to FIG. 7.

Figure 7:
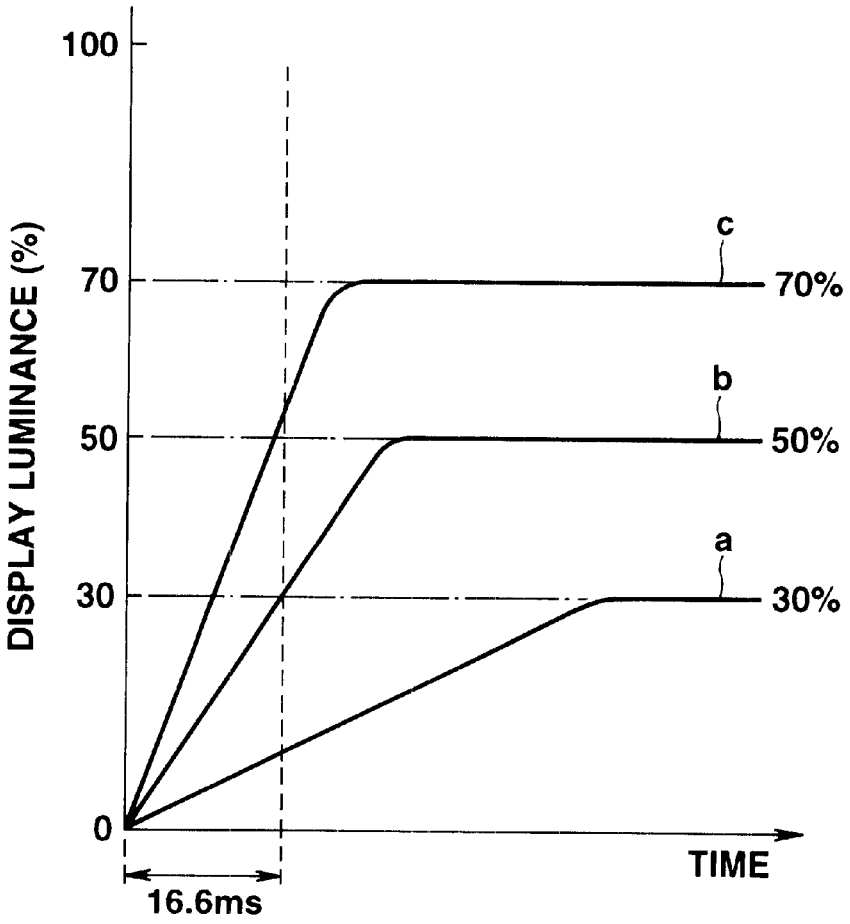
FIG. 7 is a graph illustrating response characteristics of a liquid crystal display panel, serving as the base for a method of calculating a corrected output image signal Sc.
Figure 9:
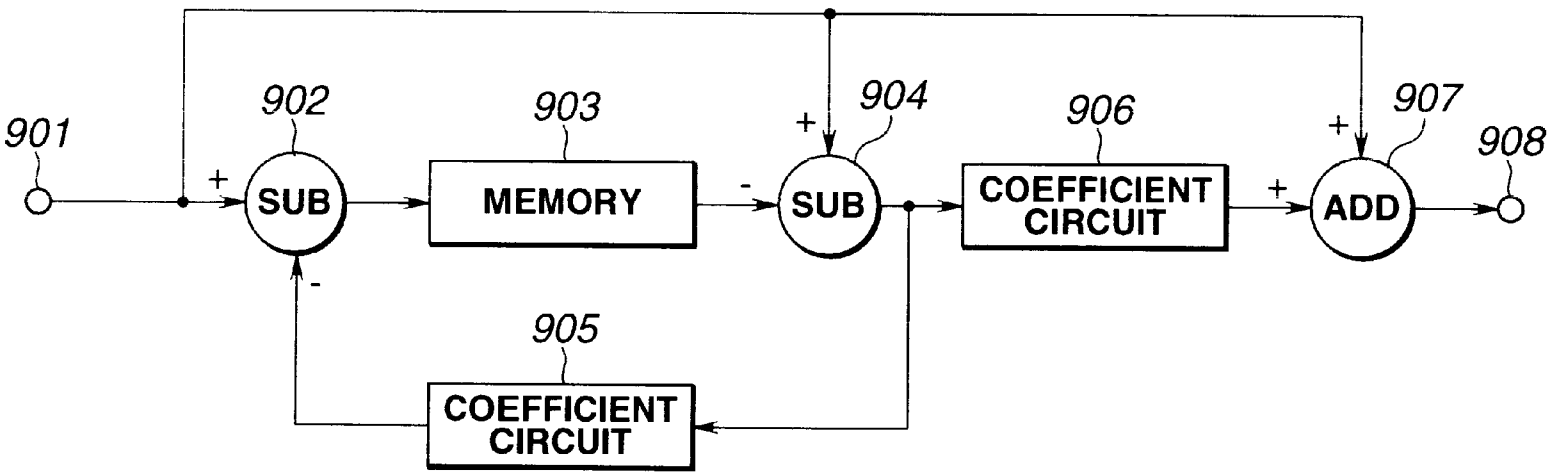
FIG.9 PRIOR ART
FIG. 9 is a schematic diagram illustrating a conventional afterimage cancelling circuit.

FIG. 7 illustrates transient response characteristics of the display luminance of the liquid crystal with respect to the stepwise input voltage.

In FIG. 7, a line "a" represents the transient characteristic when the display luminance changes from 0% to 30%. A line "b" represents the transient characteristic when the display luminance changes from 0% to 50%, and a line "c" represents the transient characteristic when the display luminance changes from 0% to 70%.

For example, since the one-field period of an NTSC TV image is about 16.6 ms (=1/60 sec), it is desired that the response speed of the liquid crystal display panel is within 16.6 ms.

When displaying a luminance of 30% with a refresh rate of 60 Hz, the luminance must reach the final value within about 16.6 ms. Actually, however, as shown in FIG. 7, the luminance reaches only about 30% of the final value (a display luminance of 10%) at about 16.6 ms.

Accordingly, afterimage is generated when displaying a moving image.

The line "b" shown in FIG. 7 can reach 30% of the display luminance at about 16.6 ms. Accordingly, when changing the luminance to be displayed after one field from 0% to 30%, a display signal such as would normally be applied to change the display luminance from 0% to 50% is applied. It is thereby possible to obtain a display luminance of 30% at 16.6 ms.

Although in the first embodiment, a description has been provided of only the case of changing the display luminance from 0%, the corrected output image signal is also calculated in the same manner for a case of changing the display luminance from a non-zero display luminance to another display luminance.

As described above, the output image signal $S_c$ after correction is determined based on the level of the input signal, the level of the input signal which precedes the current input signal by a predetermined time period, and the predetermined time period.

By applying the output image signal after correction to the liquid crystal display panel via the output teriminal 6, it is possible to provide an optimum display as indicated by is $S_o'$ shown in FIG. 6*b*.

It is not necessary that the result of calculation of the corrected image signal $S_c$ causes complete coincidence with the target luminance. The image signal $S_c$ is appropriately adjusted in consideration of necessary accuracy in calculation, the preferred result of correction, and the like.

For example, the corrected-display-image-signal calculation unit may be configured by a look-up table (hereinafter abbreviated as an "LUT") having the level of the input image signal for the current field and the level of the input image signal for the immediately preceding field as addresses, and the output image signal $S_c$ after correction as data.

Although in the first embodiment, the same pixel of the liquid crystal panel is driven at a one-field period (16.6 ms) of an NTSC signal, the driving period is not limited to this value. For example, a one-frame period of an NTSC signal, a field period or a frame period of a PAL/SECOM signal, or a period corresponding to the refresh rate of a VGA (Video Graphics Array) signal or a SVGA (super video graphics array) signal may also be adopted. In such a case, it is possible to deal with various signals by preparing in advance the characteristics of the corrected-display-image-signal calculation unit 5 corresponding to the respective signals and switching the characteristics in accordance with the type of the signal.

Instead of independently providing an LUT for each refresh rate, an LUT having a typical correction value may be commonly used.

Second Embodiment

Figure 2:
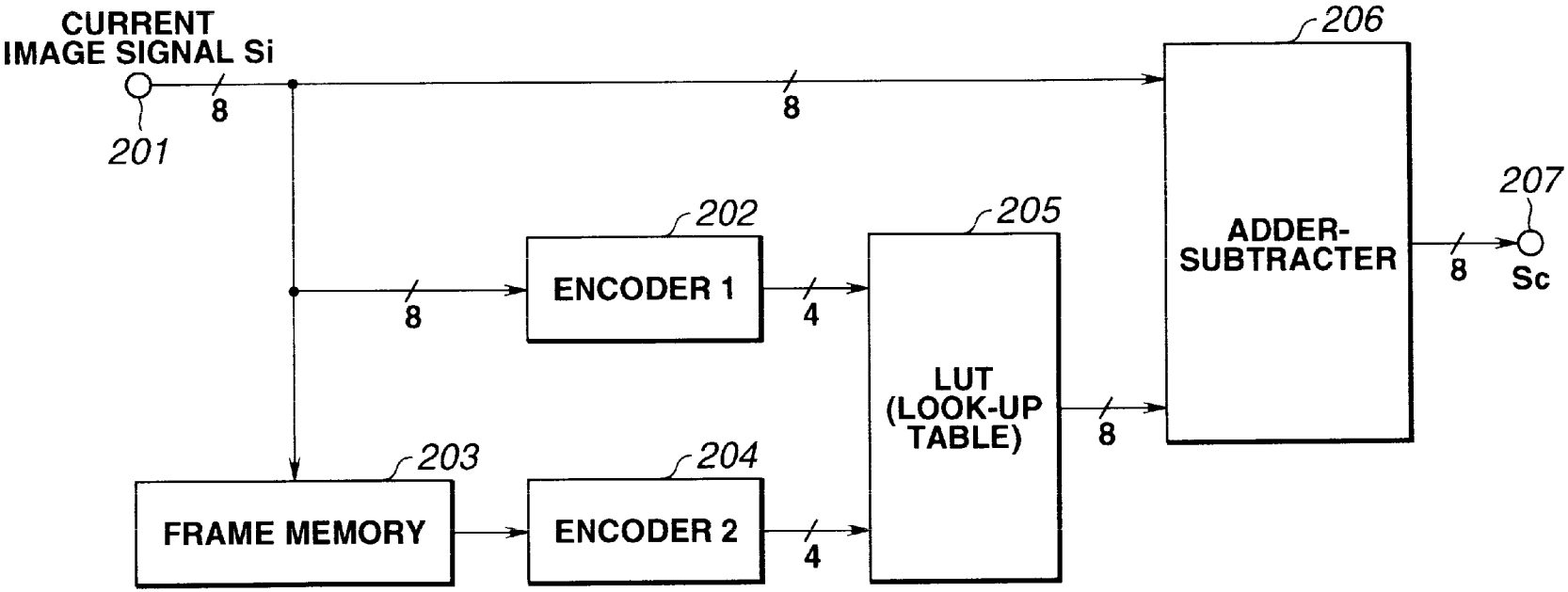
FIG. 2 is a block diagram illustrating the configuration of a liquid crystal display panel driving device according to a second embodiment of the present invention.

FIG. 2 is a block diagram illustrating the configuration of a liquid-crystal display panel driving device according to a second embodiment of the present invention. The figure illustrates an example of the detailed circuit configuration of the liquid-crystal display panel driving device of the first embodiment.

In FIG. 2, the current image signal is input to an input terminal 201, and to a first encoder circuit (encoder 1) 202. A frame memory 203 delays an image signal by one frame or one field. The image signal for the immediately preceding frame or field output from the frame memory 203 is input to a second encoder circuit (encoder 2) 204. An LUT 205 is connected to the first encoder circuit 202 and the second encoder circuit 203. An adder-subtracter 206 adds/subtracts correction data output from the LUT 205 to/from the current image signal. Reference numeral 207 represents an output terminal. The LUT 205 and the adder-subtracter 206 constitute the corrected-display-image-signal calculation unit 5 of the first embodiment.

The second embodiment will now be described in detail.

An image signal $S_i$ input to the input terminal 201 is supplied to the first encoder circuit 202. The current image signal $S_i$ comprises 8 bits.

Figure 3:
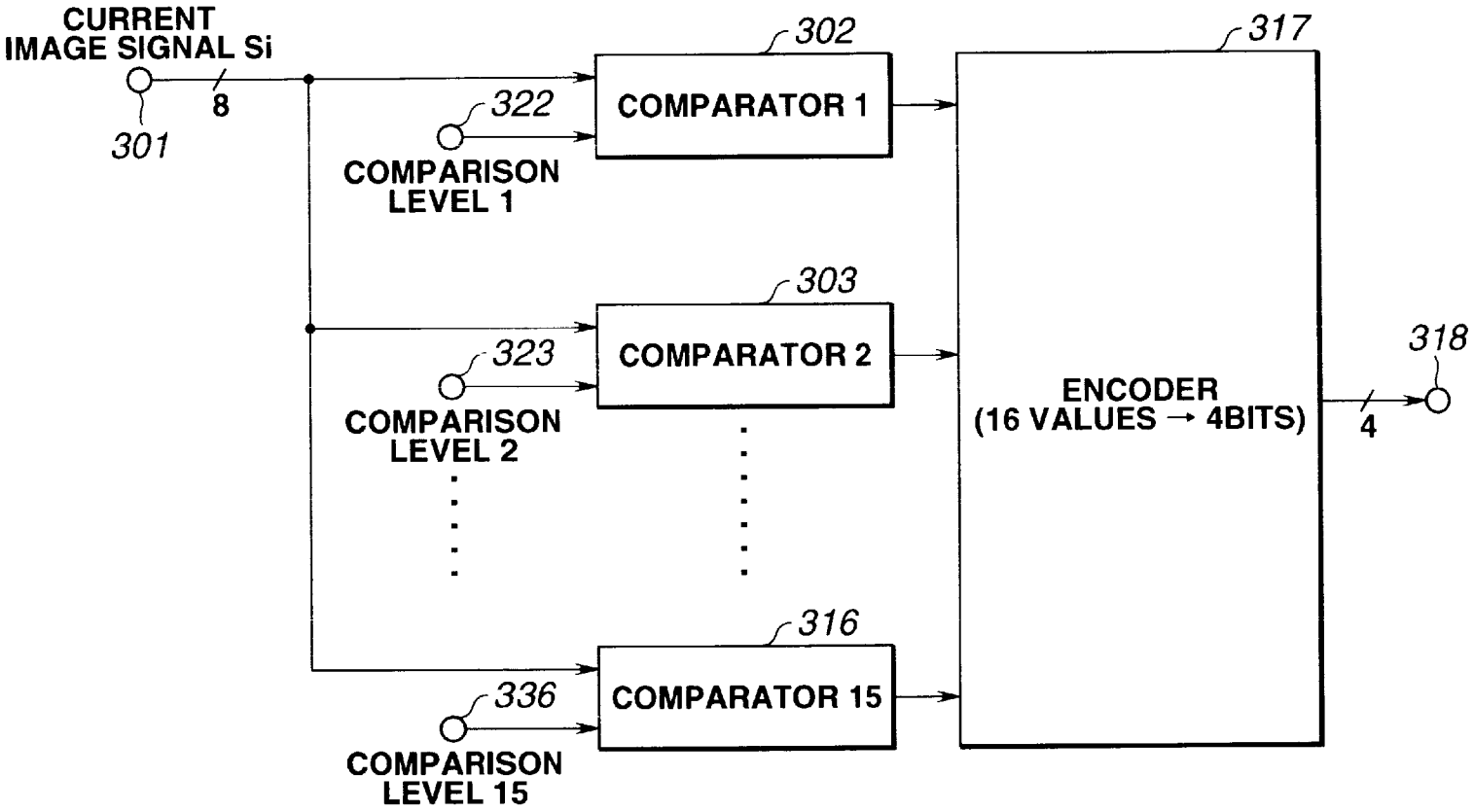
FIG. 3 is a block diagram illustrating the configuration of an encoder circuit.

FIG. 3 illustrates the detail of the first encoder circuit 202.

In FIG. 3, the image signal $S_i$ input to the encoder circuit via an input terminal 301 is compared with comparison levels 322–336 in comparators 302–316, respectively. In the second embodiment, by using 15 comparators, input 8 bits are converted into 16 states, which are converted into 4 bits by an encoder 317. Reference numeral 318 represents an output terminal.

The comparison levels are finely set in a range of signal levels where accuracy in calculation is required, and are roughly set in a range of signal levels where accuracy in calculation is not required. For example, the comparison levels are finely set in a range of low signal levels, and roughly set in a range of high signal levels.

It is thereby possible to perform weighting in accuracy in calculation depending on the level of the input signal.

In FIG. 2, a signal output from the first encoder circuit 202 is input to the LUT 205.

The image signal input from the input terminal 201 is written in the frame memory 203. When the image signal for the next frame or field is input, the image signal for the immediately preceding frame or field which has been written is read from the frame memory 203. The image signal for the immediately preceding frame or field read from the frame memory 203 is input to the second encoder circuit 204.

Since the configuration of the second encoder circuit 204 is the same as the configuration of the first encoder circuit 202 shown in FIG. 3, further description thereof will be omitted.

The image signal for the immediately preceding frame or field output from the frame memory 203 is input to the second encoder circuit 204, and is converted into a signal obtained by performing weighting in accordance with the level of the input signal. A description will be provided assuming that an 8-bit input signal is converted into a 4-bit signal, as in the first encoder circuit 202.

The signal obtained by performing weighting by the second encoder circuit 204 is input to the LUT 205.

Accordingly, the 4-bit signal output from the first encoder circuit 202 and the 4-bit signal output from the second encoder circuit 204, comprising 8 bits in total, are input to the LUT 205.

The LUT 205 receives an address comprising 8 bits, and outputs 8-bit data selected by the address.

In the second embodiment, the 4-bit data output from the first encoder circuit 202 is input to upper 4 bits of the address input of the LUT 205, and the 4-bit data output from the second encoder circuit 204 is input to lower 4 bits of the address input of the LUT 205.

Correction values corresponding to respective addresses are input as data of the LUT 205.

FIG. 8 illustrates an example of the LUT 205. The amount of correction to be added/subtracted to/from the current image signal is selected from upper 4 bits (the level of the current image signal) and lower 4 bits (the level of the image signal for the immediately preceding frame or field) of the address, and the selected amount is output.

For example, when the level of the signal for the immediately preceding frame or field is 0000b, and the level of the current image signal is 0111b, a correction value of +31 (0001 1111b) is selected.

By adding the correction value +31 to the current image signal by the adder-subtracter 206 and applying the resultant signal to the liquid crystal display panel, it is possible to display an image without degradation in the display speed.

Although in the second embodiment, the input image signal comprises 8 bits, and correction data is calculated after compressing the image signal into a 4-bit signal by the encoder circuit, the number of bits of the input signal and the number of bits to be compressed by the encoder may be appropriately selected in consideration of required accuracy in calculation and the amount of usable hardware.

For example, a simple configuration in which only upper 4 bits of the 8-bit input image signal are used may also be adopted.

It is also possible to adopt a configuration in which the 8-bit input image signal is directly input to the calculation circuit without being compressed.

Although in the second embodiment, the LUT 205 where the results of calculation performed in advance have been input and the adder-subtracter 206 are used as an example of the constitution of the corrected-display-image-signal calculation unit 5, a calculation circuit for performing calculation may be separately provided for the corrected-display-image-signal calculation unit 5. The frame memory 203 is not necessarily a particular video memory, but any memory unit having a memory function, such as an SRAM (static random access memory), a DRAM (dynamic RAM), an EDORAM (extended-data-out RAM), an SDRAM (synchronous dynamic RAM), a FIFO (first-in first-out) memory, or the like, may also be used.

Third Embodiment

Figure 4:
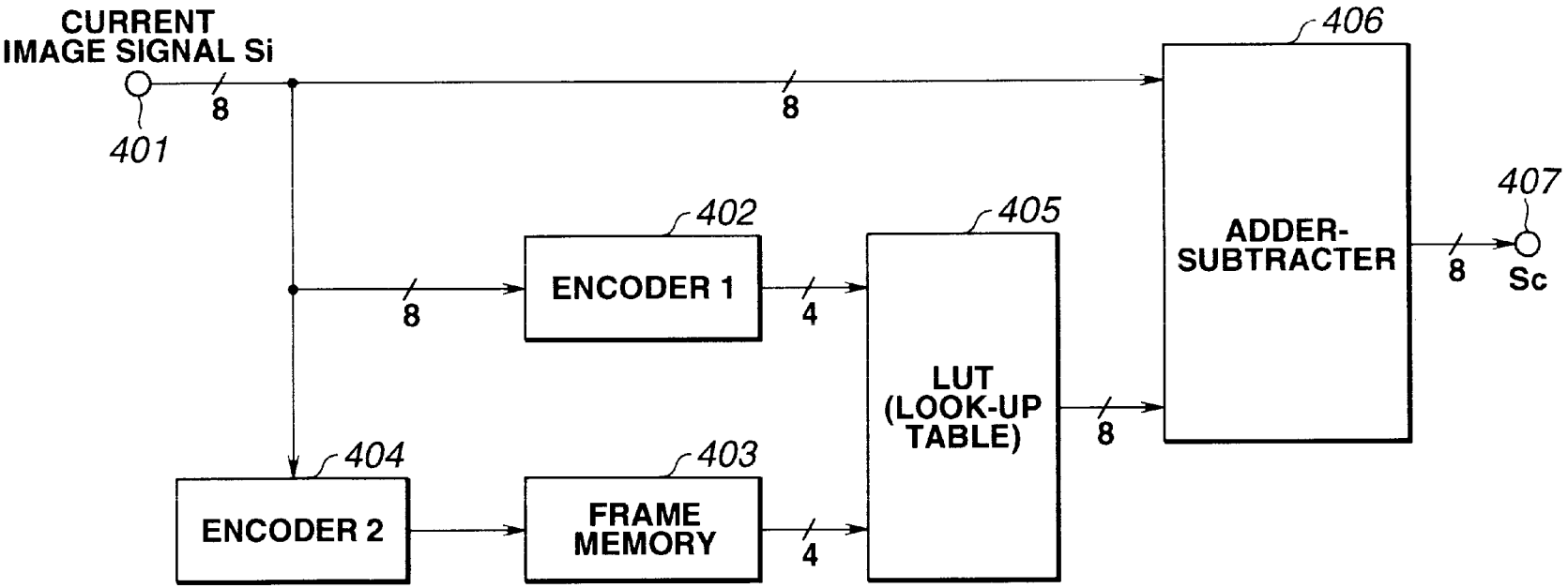
FIG. 4 is a block diagram illustrating the configuration of a liquid crystal display panel driving device according to a third embodiment of the present invention.

FIG. 4 is a block diagram illustrating the configuration of a liquid crystal display panel driving device according to a third embodiment of the present invention.

In this configuration, the level of a signal is detected by a second encoder circuit 404, and after compressing the signal, the resultant signal is written in a frame memory 403.

According to this configuration, it is possible to reduce the number of bits written in the frame memory. Hence, a small-capacity memory can be used, resulting in reduction in the cost.

Fourth Embodiment

Figure 5:
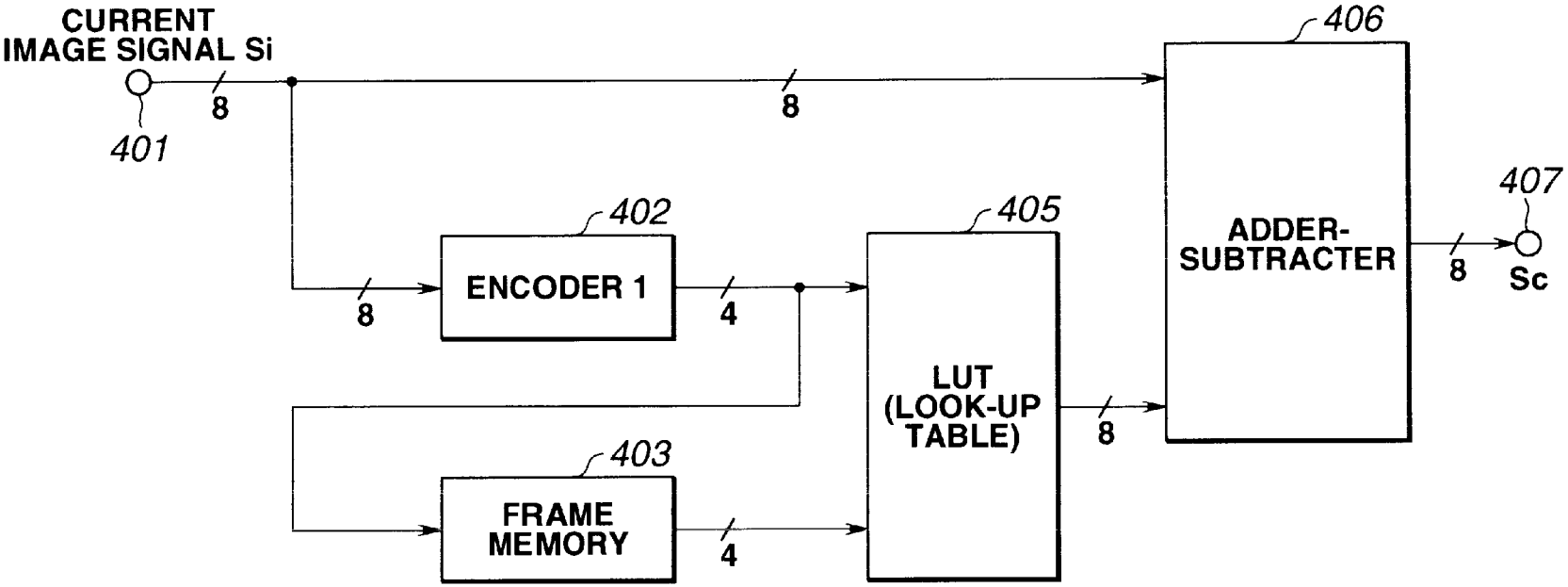
FIG. 5 is a block diagram illustrating the configuration of a liquid crystal display panel driving device according to a fourth embodiment of the present invention.

FIG. 5 is a block diagram illustrating the configuration of a liquid crystal display panel driving device according to a fourth embodiment of the present invention.

The fourth embodiment differs from the third embodiment in that the second encoder 404 is removed, and the output of the first encoder 402 is directly written in the frame memory 403. The configuration of the fourth embodiment can be adopted when the range of level detection by the second encoder circuit 404 is the same as the range of level detection by the first encoder circuit 402.

The fourth embodiment allows that the amount of hardware to be further reduced and the cost to be thereby reduced when compared with the third embodiment.

The individual components designated by blocks in the drawings are all well-known in the liquid crystal display panel driving device and method arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A display panel driving device comprising:

an input terminal for receiving an input image signal;

first signal level detection means for detecting a signal level of an image signal transmitted through a first signal line connected to said input terminal;

memory means for storing an image signal transmitted through a second signal line connected to said input terminal and for delaying and outputting said image signal by an arbitrary constant time period;

second signal level detection means for detecting a signal level of an output of said memory means; and corrected-display-image-signal calculation means for correcting an image signal input through a third signal line connected to said input terminal based on a first output from said first signal level detection means and a second output from said second signal level detection means.

2. A display panel driving device comprising:

an input terminal for receiving an input image signal;

first encoding means for encoding a signal level of an image signal transmitted through a first signal line connected to said input terminal;

memory means for storing an image signal transmitted through a second signal line connected to said input terminal and for delaying and outputting said image signal by an arbitrary constant time period;

second encoding means for encoding a signal level of an output of said memory means; and corrected-display-image-signal calculation means for correcting an image signal input through a third signal line connected to said input terminal based on a first output from said first encoding means and a second output from said second encoding means.

3. A display panel driving device comprising:

an input terminal for receiving an input image signal;

first encoding means for encoding a signal level of an image signal transmitted through a first signal line connected to said input terminal;

second encoding means for encoding a signal level of an image signal transmitted through a second signal line connected to said input terminal;

memory means for storing and delaying an output of said second encoding means by an arbitrary constant time period;

corrected-display-image-signal calculation means for correcting an image signal input through a third signal line connected to said input terminal based on a first encoded output from said first encoding means and a second encoded output from said memory means; and addition-subtraction means for adding/subtracting said correction value to/from said input image signal.

4. A display panel driving device comprising:

an input terminal for receiving an input image signal;

encoding means for encoding a signal level of an image signal transmitted through a first signal line connected to said input terminal;

memory means for storing an image signal transmitted through a second signal line connected to said encoding means and for delaying and outputting said image signal by an arbitrary constant time period;

a look-up table for setting a correction value based on a first output which was input through a third signal line connected to said memory means and a second output which was input through a fourth signal line connected to said encoding means;

corrected-display-image-signal calculation means for correcting an image signal input through a fifth signal line connected to said input terminal in accordance with the output from said look-up table.

5. A device according to claim 1, wherein said corrected-display-image-signal calculation means corrects the input image signal so as to maintain a linear relationship between the difference between the output of said first signal level detection means and the output of said second signal level detection means and a step level of a display luminance of a liquid-crystal display panel, based, in dependence upon a value of a step response output in a relationship between a driving voltage and the display luminance of the liquid-crystal display panel after said constant time period, on levels before and after the step.

6. A display panel driving device according to any one of claims 1 to 4, wherein said display panel driving device is a liquid crystal display panel driving device.

7. A display panel driving device according to any one of claims 1 to 3, wherein said corrected-image-signal calculation means comprises a look-up table.

* * * * *

UNITED STATES PATENT AND TRADEMARK OFFICE

CERTIFICATE OF CORRECTION

PATENT NO. : 6,501,451 B1
DATED : December 31, 2002
INVENTOR(S) : Yukihiko Sakashita It is certified that error appears in the above-identified patent and that said Letters Patent is hereby corrected as shown below:

Column 16,
Line 47, "by is" should read -- by --.

Signed and Sealed this

Fourteenth Day of October, 2003

JAMES E. ROGAN
*Director of the United States Patent and Trademark Office*